US009175507B2

(12) United States Patent
Davis

(10) Patent No.: US 9,175,507 B2
(45) Date of Patent: Nov. 3, 2015

(54) ADJUSTABLE DOOR JAMB WRAP FOR EXTERIOR DOOR JAMB

(71) Applicant: David P. Davis, Blue Ridge, TX (US)

(72) Inventor: David P. Davis, Blue Ridge, TX (US)

( * ) Notice: Subject to any disclaimer, the term of this patent is extended or adjusted under 35 U.S.C. 154(b) by 0 days.

(21) Appl. No.: 14/444,728

(22) Filed: Jul. 28, 2014

(65) Prior Publication Data

US 2015/0159420 A1 Jun. 11, 2015

Related U.S. Application Data

(63) Continuation of application No. 13/212,866, filed on Aug. 18, 2011, now abandoned.

(60) Provisional application No. 61/374,972, filed on Aug. 18, 2010.

(51) Int. Cl.

| | |
|---|---|
| ***E06B 7/16*** | (2006.01) |
| ***E06B 1/62*** | (2006.01) |
| ***E06B 7/28*** | (2006.01) |
| ***E06B 1/34*** | (2006.01) |

(52) U.S. Cl.

CPC ... *E06B 1/62* (2013.01); *E06B 1/34* (2013.01); *E06B 7/16* (2013.01); *E06B 7/28* (2013.01); *E06B 2001/622* (2013.01)

(58) Field of Classification Search

CPC ..... E06B 1/045; E06B 1/20; E06B 1/347; E06B 2001/622; E06B 2001/628; E06B 7/28; E04F 19/028

USPC ..... 52/210, 212, 213, 716.8, 717.06, 101, 52/204.54, 741.3, 745.15, 170, 835

See application file for complete search history.

(56) References Cited

U.S. PATENT DOCUMENTS

| | | | | | |
|---|---|---|---|---|---|
| 1,048,988 | A | * | 12/1912 | Mayo | 52/212 |
| 1,995,858 | A | * | 3/1935 | Mearns, Jr. | 49/410 |
| 2,579,943 | A | * | 12/1951 | Marchand | 52/312 |
| 2,837,787 | A | * | 6/1958 | Wright | 52/717.01 |
| 2,853,161 | A | * | 9/1958 | Mascari | 52/212 |
| 2,942,703 | A | * | 6/1960 | Nels | 52/718.01 |
| 3,010,548 | A | * | 11/1961 | Canalini | 52/792.1 |
| 3,318,061 | A | * | 5/1967 | Stentz | 52/288.1 |
| 3,717,968 | A | * | 2/1973 | Olsen et al. | 52/288.1 |
| 4,443,508 | A | * | 4/1984 | Mehl | 428/122 |

(Continued)

FOREIGN PATENT DOCUMENTS

| | | | | | |
|---|---|---|---|---|---|
| CA | 2015644 | C | * | 11/1994 | E06B 1/56 |
| CA | 2416466 | C | * | 3/2006 | E06B 7/28 |

(Continued)

*Primary Examiner* — Brent W Herring

(74) *Attorney, Agent, or Firm* — Vincent J. Allen; Carstens & Cahoon, LLP

(57) ABSTRACT

An adjustable door jamb wrap for use on a door jamb of an exterior door. The adjustable door jamb wrap covers openings next to the door that are commonly found on door jambs with beveled edges. The door jamb wrap includes an outer bracket having an "L" shape. The door jamb wrap also includes an inner bracket having an "L" shape, the inner bracket slidably coupled to the outer bracket. The inner bracket and the outer bracket together form a "C" shape having an adjustable size and configured to surround a bottom edge of the door jamb.

10 Claims, 5 Drawing Sheets

(56) References Cited

U.S. PATENT DOCUMENTS

| | | | | |
|---|---|---|---|---|
| 4,677,791 | A * | 7/1987 | Larson et al. | 49/463 |
| 4,735,025 | A * | 4/1988 | Day | 52/217 |
| 4,768,320 | A * | 9/1988 | Weller | 52/211 |
| 5,203,130 | A * | 4/1993 | Freelove | 52/211 |
| 5,445,244 | A * | 8/1995 | Ketonen | 187/325 |
| 6,216,408 | B1 * | 4/2001 | Davidson | 52/300 |
| 6,684,572 | B2 * | 2/2004 | Homolka et al. | 49/462 |
| 6,694,696 | B2 * | 2/2004 | Hagel | 52/656.4 |
| 6,703,102 | B1 * | 3/2004 | Prescott | 428/76 |
| 7,047,702 | B1 * | 5/2006 | Callens et al. | 52/716.1 |
| 7,100,339 | B2 * | 9/2006 | Hagel | 52/656.4 |
| 7,204,059 | B2 * | 4/2007 | Schiffmann et al. | 52/211 |
| 7,926,232 | B2 * | 4/2011 | de Raucourt | 52/288.1 |
| 8,091,299 | B2 * | 1/2012 | Katz | 52/211 |
| 8,640,763 | B1 * | 2/2014 | Laengle et al. | 160/351 |
| 2004/0221527 | A1 * | 11/2004 | Sykora | 52/213 |
| 2009/0013636 | A1 * | 1/2009 | Wilson | 52/718.01 |

FOREIGN PATENT DOCUMENTS

| | | | | |
|---|---|---|---|---|
| DE | 102007056395 | A1 * | 5/2009 | E06B 1/34 |
| EP | 1840313 | A1 * | 10/2007 | E06B 1/20 |
| WO | WO 9707313 | A1 * | 2/1997 | E06B 1/20 |

* cited by examiner

ADJUSTABLE DOOR JAMB WRAP FOR EXTERIOR DOOR JAMB

CROSS-REFERENCE TO RELATED APPLICATION

This application is a continuation of prior application Ser. No. 13/212,866, filed on Aug. 18, 2011, which claims priority under 35 USC 119(e) to U.S. provisional Application Ser. No. 61/374,972, filed on Aug. 18, 2010, and which are incorporated herein by reference.

TECHNICAL FIELD

The present invention relates generally to door frames and door jambs, and more particularly to an adjustable, protective jamb wrap for a door jamb for an exterior door.

BACKGROUND

A structure, such as a garage, storage unit, or warehouse, typically has one or more doors to the exterior environment. In many cases, these doors are overhead doors that are formed in sections and slide overhead along a track. Most doors, including overhead doors, are surrounded by a door jamb. The door jamb frames the door, and in some cases, provides support for the door. In the case of an exterior overhead door, the door jamb is frequently constructed with a beveled edge near the ground. The beveled edge typically creates a small gap or opening at the bottom of the jamb where the overhead door meets the jamb. The small opening is large enough for pests, such as insects or rodents, to enter the structure. The small opening is often plugged with steel wool, plastic foam, or another material, in an attempt to keep pests out of the structure. However, such materials are unsightly, and are often damaged or swept away during cleaning, or chewed through by rodents. These shortcomings may be unacceptable to the owner or manager of the structure.

Accordingly, there is a need in the art for a protective device to close off the opening formed at the bottom of the door jamb.

SUMMARY

In accordance with one embodiment, there is provided an adjustable door jamb wrap for use on a door jamb of an exterior door. The door jamb wrap includes an outer bracket having an "L" shape. The door jamb wrap also includes an inner bracket having an "L" shape, the inner bracket slidably coupled to the outer bracket. The inner bracket and the outer bracket together form a "C" shape having an adjustable size and configured to surround a bottom edge of the door jamb.

In accordance with another embodiment, there is provided a structure having an exterior door, the exterior door having a door jamb, the door jamb a top jamb and first and second side jambs. Each side jamb includes an adjustable door jamb wrap. Each door jamb wrap includes an outer bracket having an "L" shape. Each door jamb wrap also includes an inner bracket having an "L" shape, the inner bracket slidably coupled to the outer bracket. The inner bracket and outer bracket together form a "C" shape having an adjustable size and configured to surround a bottom edge of the door jamb.

In yet another embodiment, there is provided a method for covering an opening at a bottom edge of a door jamb of an exterior door. The method includes placing an inner bracket of an adjustable door jamb wrap against the bottom end of the door jamb. The method also includes placing an outer bracket of the door jamb wrap adjacent the inner bracket. The method further includes sliding the outer bracket over the inner bracket until the inner bracket and outer bracket together form a "C" shape surrounding the bottom edge of the door jamb.

Other technical features may be readily apparent to one skilled in the art from the following figures, descriptions, and claims.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

The present disclosure describes an adjustable jamb wrap. Such a device may be employed around the door jamb of an exterior door, such as an overhead door. Such an overhead door is commonly found on garages, storage buildings, warehouses, and other commercial and residential buildings.

Figure 1A:
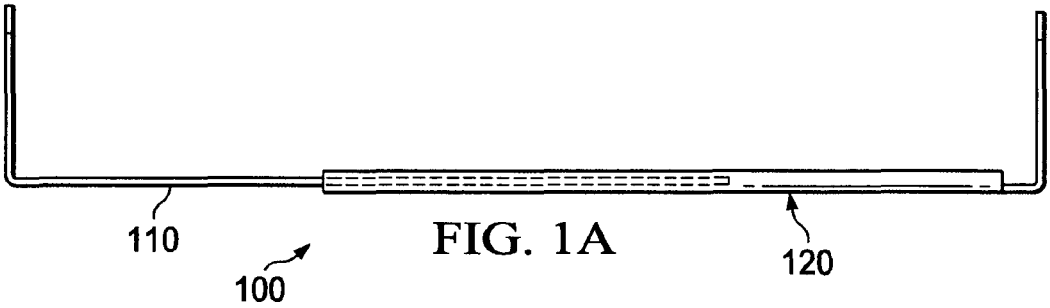
FIGS. 1A and 1B illustrate top and back views, respectively, of an adjustable jamb wrap for use around a door jamb in accordance with one embodiment.
Figure 1B:
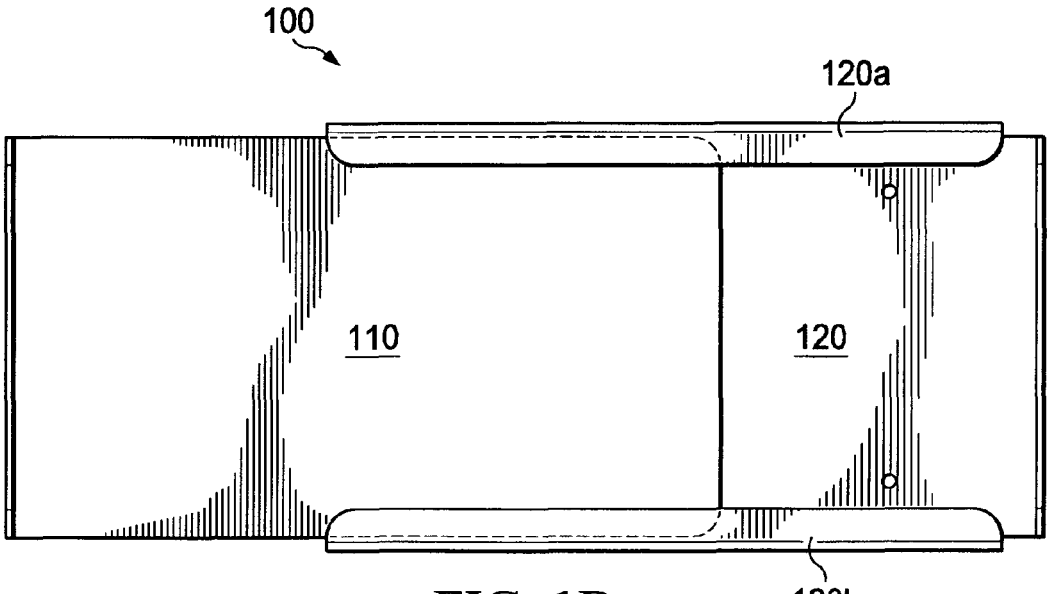

FIGS. 1A and 1B illustrate top and back views, respectively, of an adjustable jamb wrap 100 for use around a door jamb in accordance with one embodiment. The jamb wrap 100 includes an inner bracket 110 and an outer bracket 120. The inner bracket 110 and the outer bracket 120 are L-shaped brackets that slide together, as depicted in FIG. 1A. Both brackets 110, 120 are formed from thin sheet material or another suitable material, as described in greater detail below.

The outer bracket 120 includes a top tab 120*a* and a bottom tab 120*b* that fold over the outer bracket 120, as depicted in FIG. 1B. The tabs 120*a*, 120*b* form grooves into which the inner bracket 110 may slide, as depicted by the dotted lines in FIG. 1B. The inner bracket 110 may slide left and right (or inward and outward) with respect to the outer bracket 120, where the sliding motion is constrained by the tabs 120*a*, 120*b*. By sliding the inner bracket 110 with respect to the outer bracket 120 to an appropriate point, an installer can create a C-shaped jamb wrap 100 that has an overall width suitable for doors jambs in a variety of sizes. This is described in greater detail below.

Figure 2A:
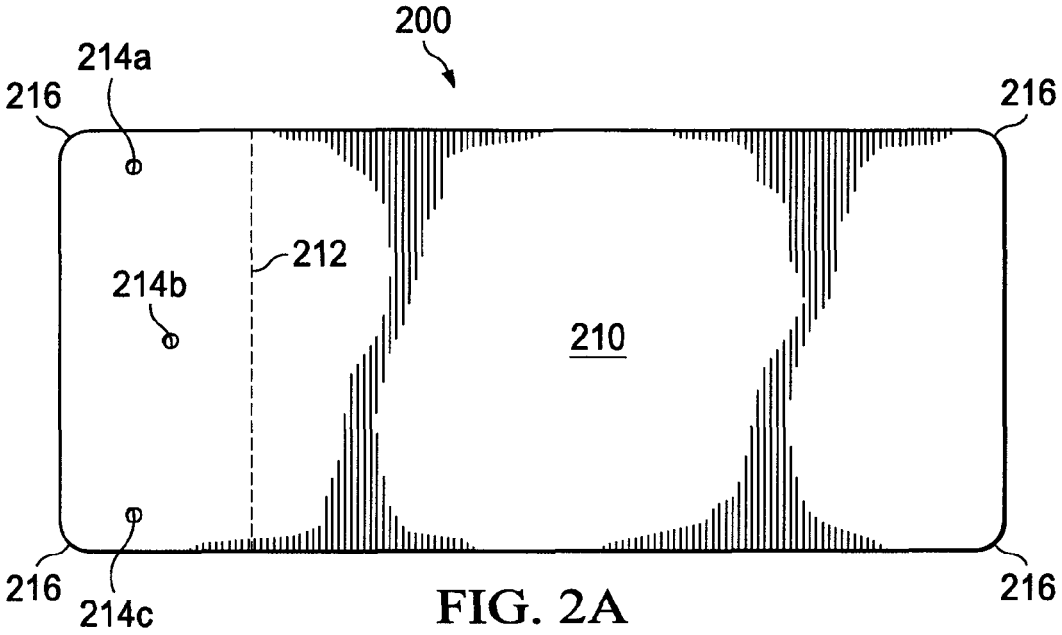
FIGS. 2A and 2B illustrate different views of an inner bracket of an adjustable jamb wrap in accordance with one preferred embodiment.
Figure 2B:
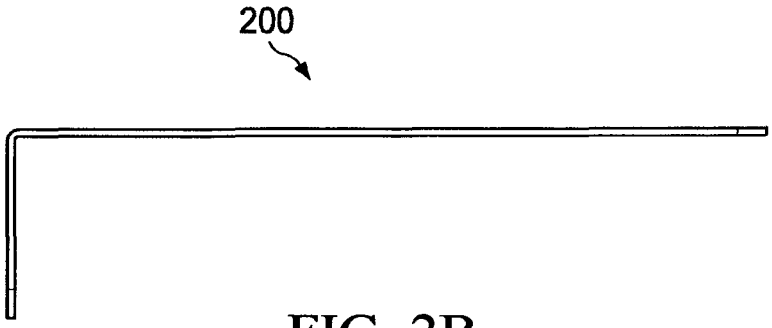

FIGS. 2A and 2B illustrate different views of an inner bracket 200 of an adjustable jamb wrap in accordance with one preferred embodiment. The inner bracket 200 may represent the inner bracket 110 of the jamb wrap 100 shown in FIGS. 1A and 1B.

The inner bracket 200 is formed of a flat, substantially rectangular piece of sheet metal 210, as depicted in FIG. 2A. In a preferred embodiment, the sheet metal 210 is 24 gauge steel approximately four inches (4") in width and approximately eight and seven tenths inches (8.7") in length. Other dimensions may be selected for the inner bracket 200 as necessary for the chosen size of the jamb wrap 100. Twenty-four gauge steel offers superior machining properties, durability, and resistance to damage by pests. In addition, it is thin enough to be easily bent and readily slide under any trim or moulding pieces that may be installed on the door jamb, as described in greater detail below. In other embodiments, other suitable materials, such as aluminum or plastic, may be used, as long as the materials are impervious or resistant to damage by pests and/or weather. Thinner or thicker materials may be used as well.

The sheet metal 210 is designed to be bent along a bend line 212. During manufacture, the sheet metal 210 is bent approximately ninety degrees (90°) along the bend line 212 to form the "L" shaped inner bracket 200 depicted in FIG. 2B. In a preferred embodiment, the bend line 212 is located approximately seven inches (7") from one end of the sheet metal 210. In other embodiments, the bend line 212 may be located a shorter or greater distance from one end of the sheet metal 210.

The sheet metal 210 includes three (3) holes 214*a*-214*c* that provide a location to affix the inner bracket 200 to the door jamb using screws, nails, or other suitable fasteners. The holes 214*a*-214*c* are located horizontally approximately half-way between one edge of the sheet metal 210 and the bend line 212. In a preferred embodiment, the holes 214*a*, 214*c* are aligned vertically and are offset horizontally from the middle hole 214*b*. In a preferred embodiment, the holes 214*a*, 214*c* are located approximately three-eighths of an inch (⅜") from the top and bottom edges, respectively, of the sheet metal 210. The middle hole 214*b* is centered vertically on the sheet metal 210. Although the sheet metal 210 is described with three (3) holes arranged as depicted, it will be understood that more or fewer holes or holes arranged in other configurations may be used as long as the arrangement of holes provides a means for securely affixing the inner bracket 200 to a door jamb.

The sheet metal 210 includes four rounded corners 216. The rounded corners 216 facilitate the inner bracket 200 easily aligning with and sliding into the grooves formed in the outer bracket (e.g., outer bracket 120) of the jamb wrap. Additionally, the rounded corners 216 eliminate sharp points associated with square corners that could injure an installer or mar a surface of the door jamb during installation of the jamb wrap.

Figure 3A:
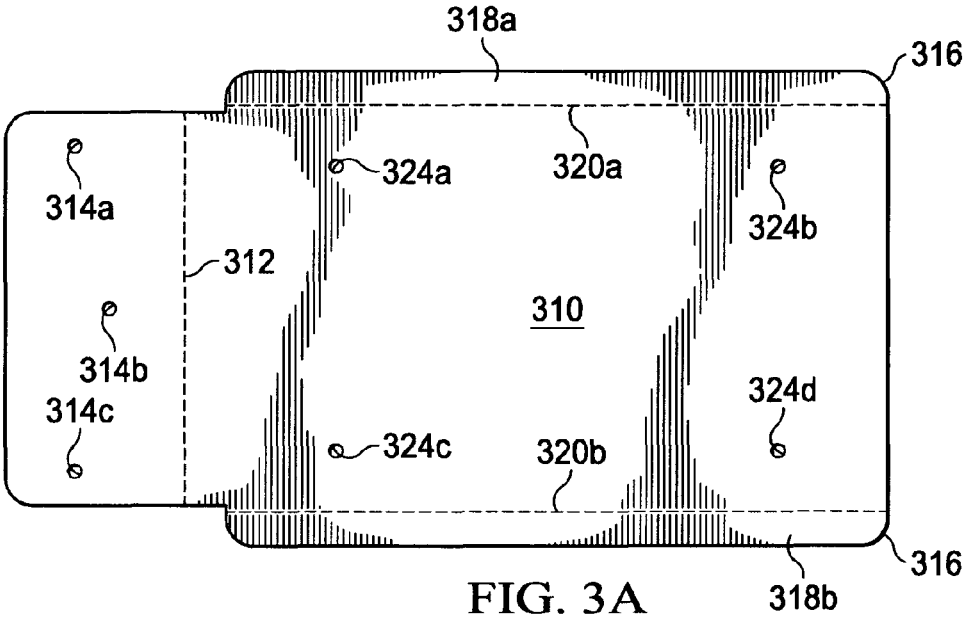
FIGS. 3A through 3C illustrate different views of an outer bracket of an adjustable jamb wrap in accordance with one preferred embodiment.
Figure 3B:
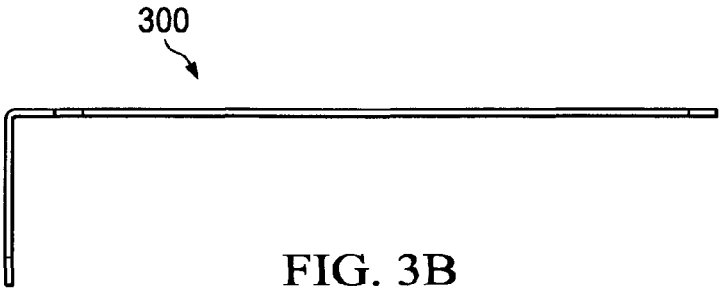
Figure 3C:
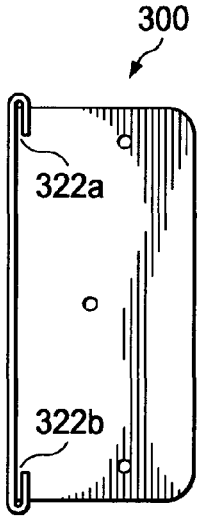

FIGS. 3A through 3C illustrate different views of an outer bracket 300 of an adjustable jamb wrap in accordance with one preferred embodiment. The outer bracket 300 may represent the outer bracket 120 of the adjustable jamb wrap 100 shown in FIGS. 1A and 1B.

Like the inner bracket 200 depicted in FIG. 2A, the outer bracket 300 is formed from a flat piece of sheet metal 310, as depicted in FIG. 3A. In a preferred embodiment, the sheet metal 310 is 24 gauge steel approximately four and nine tenths inches (4.9") in width and eight and seven tenths inches (8.7") in length. Other dimensions may be selected for the outer bracket 300 as necessary for the chosen size of the jamb wrap 100. In addition, other materials having the same or different thickness may be used. In some embodiments, the inner bracket 200 and the outer bracket 300 will be formed from the same material.

The sheet metal 310 is designed to be bent along a bend line 312. During manufacture, the sheet metal 310 is bent approximately ninety degrees (90°) along the bend line 312 to form the "L" shaped inner bracket 300 depicted in FIG. 3B. In a preferred embodiment, the bend line 312 is located approximately seven inches (7") from one end of the sheet metal 310. In other embodiments, the bend line 312 may be located a shorter or greater distance from one end of the sheet metal 310.

The sheet metal 310 includes a top tab 318*a* and a bottom tab 318*b*. In a preferred embodiment, the tabs 318*a*, 318*b* are approximately six and six tenths inches (6.6") long and approximately four tenths of an inch (0.4") wide. The inner edge of the tab 318*a* is defined by a hem line 320*a*. Likewise, the inner edge of the tab 318*b* is defined by a hem line 320*b*. The tabs 318*a*, 318*b* are designed to be folded over along the hem lines 320*a*, 320*b*. During manufacture, the tabs 318*a*, 318*b* are bent or folded approximately one hundred eighty degrees (180°) along the hem lines 320*a*, 320*b* to form the flat "C" shape as depicted in the cross-section view of the outer bracket 300 in FIG. 3C. In one embodiment, the tabs 318*a*, 318*b* are folded in the same direction as the sheet metal 310 is bent along the bend line 312. In some embodiments, each tab 318*a*, 318*b* may be folded over a shim approximately six hundredths of an inch (0.06") thick (not shown). The shim is used during manufacture to assist in the folding or bending step, and may be removed once the fold is complete. Once folded, the tabs 318*a*, 318*b* define a top groove 322*a* and a bottom groove 322*b*, as depicted in FIG. 3C. The grooves 322*a*, 322*b* accept one edge of the inner bracket 200 and constrain the inner bracket 200 to a sliding motion along the outer bracket 300. The tabs 318*a*, 318*b* include rounded corners 316. The rounded corners 316 facilitate the inner bracket 200 easily aligning with and sliding into the grooves 322*a*, 322*b*.

The sheet metal 210 includes seven (7) holes 314*a*-314*c* and 324*a*-324*d* that provide a location to affix the outer bracket 300 to the door jamb using screws, nails, or other suitable fasteners. Three of the holes 314*a*-314*c* are located horizontally approximately half-way between one edge of the sheet metal 310 and the bend line 312. In a preferred embodiment, the holes 314*a*, 314*c* are aligned vertically and are offset horizontally from the middle hole 314*b*. In a preferred embodiment, the holes 314*a*, 314*c* are located approximately three-eighths of an inch (⅜") from the top and bottom edges, respectively, of the sheet metal 310. The middle hole 314*b* is centered vertically on the sheet metal 310.

The remaining four (4) holes 324*a*-324*d* are located on the side of the bend line 312 opposite the holes 314*a*-314*c*. In a preferred embodiment, the holes 324*a*-324*d* are arranged in a rectangular pattern approximately one inch (1") from the top and bottom edges of the sheet metal 310, approximately one and five eighths inches (1⅝") from the bend line 312, and approximately two inches (2") from the right edge of the sheet metal 310.

Although the sheet metal 310 is described with seven (7) holes arranged as depicted, it will be understood that more or fewer holes or holes arranged in other configurations may be used as long as the arrangement of holes provides a means for securely affixing the outer bracket 300 to a door jamb.

Figure 4:
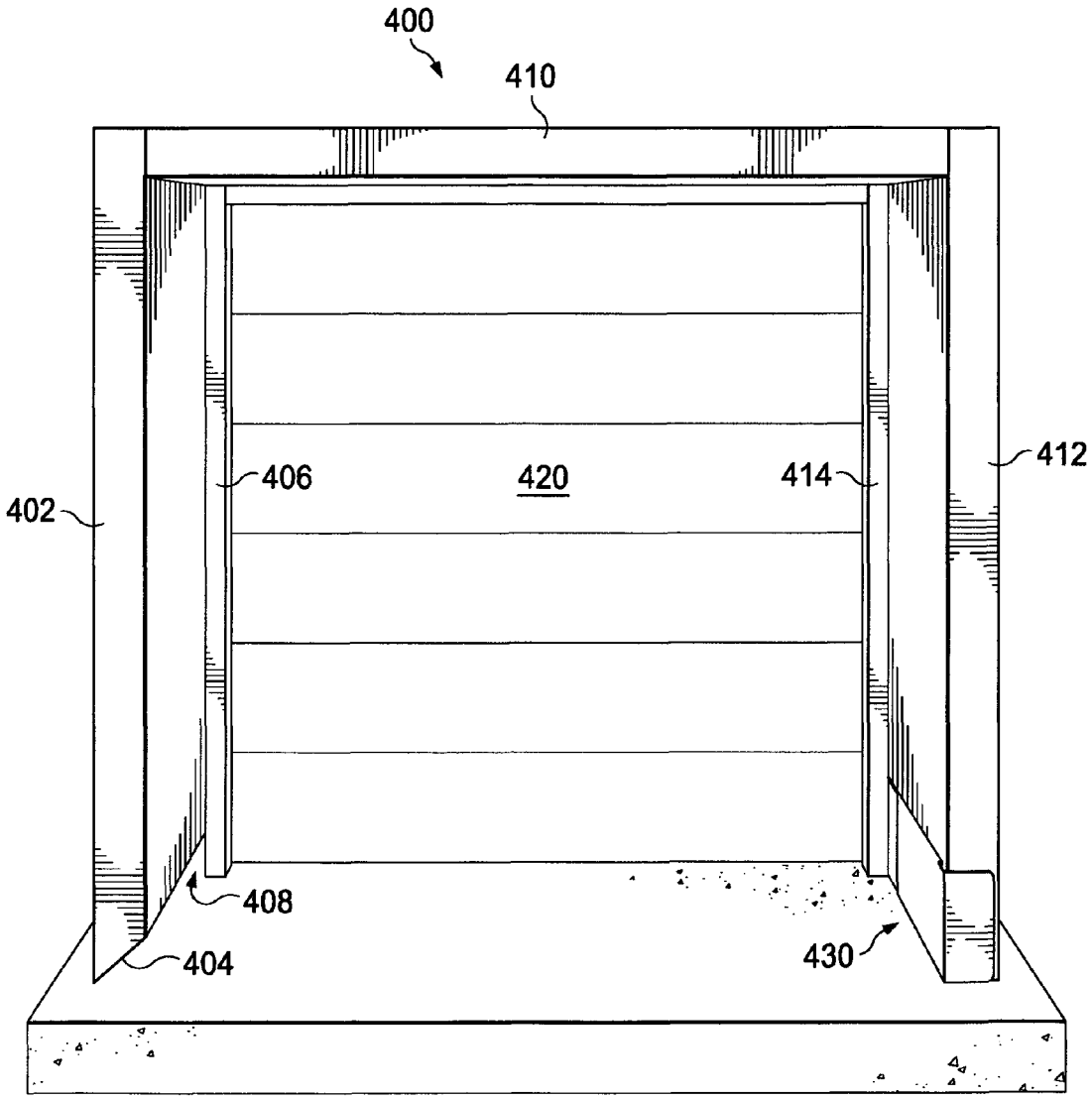
FIG. 4 illustrates a front view of a door jamb with an adjustable jamb wrap installed on one side of the door jamb, in accordance with one embodiment.

FIG. 4 illustrates a front view of a door jamb 400 with an adjustable jamb wrap 430 installed on one side of the door jamb 400, in accordance with one embodiment. The jamb wrap 430 may represent the adjustable jamb wrap 100 shown in FIGS. 1A and 1B. The door jamb 400 is constructed of wood, concrete board, or another suitable construction material, and includes a left jamb 402, a top jamb 410, and a right jamb 412 that surround a door 420. In certain embodiments, the door 420 may be an overhead exterior door to a structure, such as a garage or a warehouse.

The left jamb 402 includes a beveled bottom edge 404 that tapers from the thickness of the left jamb 402 down to approximately zero thickness at the bottom. The beveled bottom edge 404 typically serves as a decorative feature and to minimize the amount of wood that contacts the ground. Wood in direct contact with the ground can lead to moisture problems, such as rot. The right jamb 406 includes a corresponding beveled bottom edge, although the beveled edge of the right jamb 406 is hidden by the jamb wrap 430 in FIG. 4.

The left jamb 402 also includes a trim piece 406 that is narrower than the left jamb 402 and is positioned adjacent to the door 420. The trim piece 406 is typically a decorative feature that provides a clean-looking transition between the door 420 and the left jamb 402. In certain embodiments, the trim piece 406 extends substantially or completely to the ground, such as shown in FIG. 4. In other embodiments, the trim piece 406 extends approximately to the start of the beveled bottom edge 404, or to another point along the left jamb 402. The right jamb 412 includes a similar trim piece 414.

As shown in FIG. 4, the beveled bottom edge 404 of the left jamb 402 exposes a small opening 408 adjacent the bottom left corner of the door 420, between the beveled bottom edge 404, the trim piece 406, and the ground. The opening 408 passes to the left edge of the door 420 into the interior space of the structure. In other words, the opening 408 provides a small portal from the exterior to the interior of the structure, through which rodents, large insects, and other pests may enter the structure. A corresponding opening is located near the bottom of the right jamb 412, although it is hidden and blocked by the jamb wrap 430.

As shown in FIG. 4 (and in greater detail in FIG. 5), the jamb wrap 430 surrounds the bottom part of the right jamb 412. When installed, the jamb wrap 430 fits tightly around the right jamb 412 and contacts (or is in very close proximity to) the ground. The jamb wrap 430 covers the beveled bottom edge of the right jamb 412 and completely hides the opening to the structure below the beveled edge. Thus, the jamb wrap 430 blocks the opening that allows pests to enter the structure near the right jamb 412.

Figure 5:
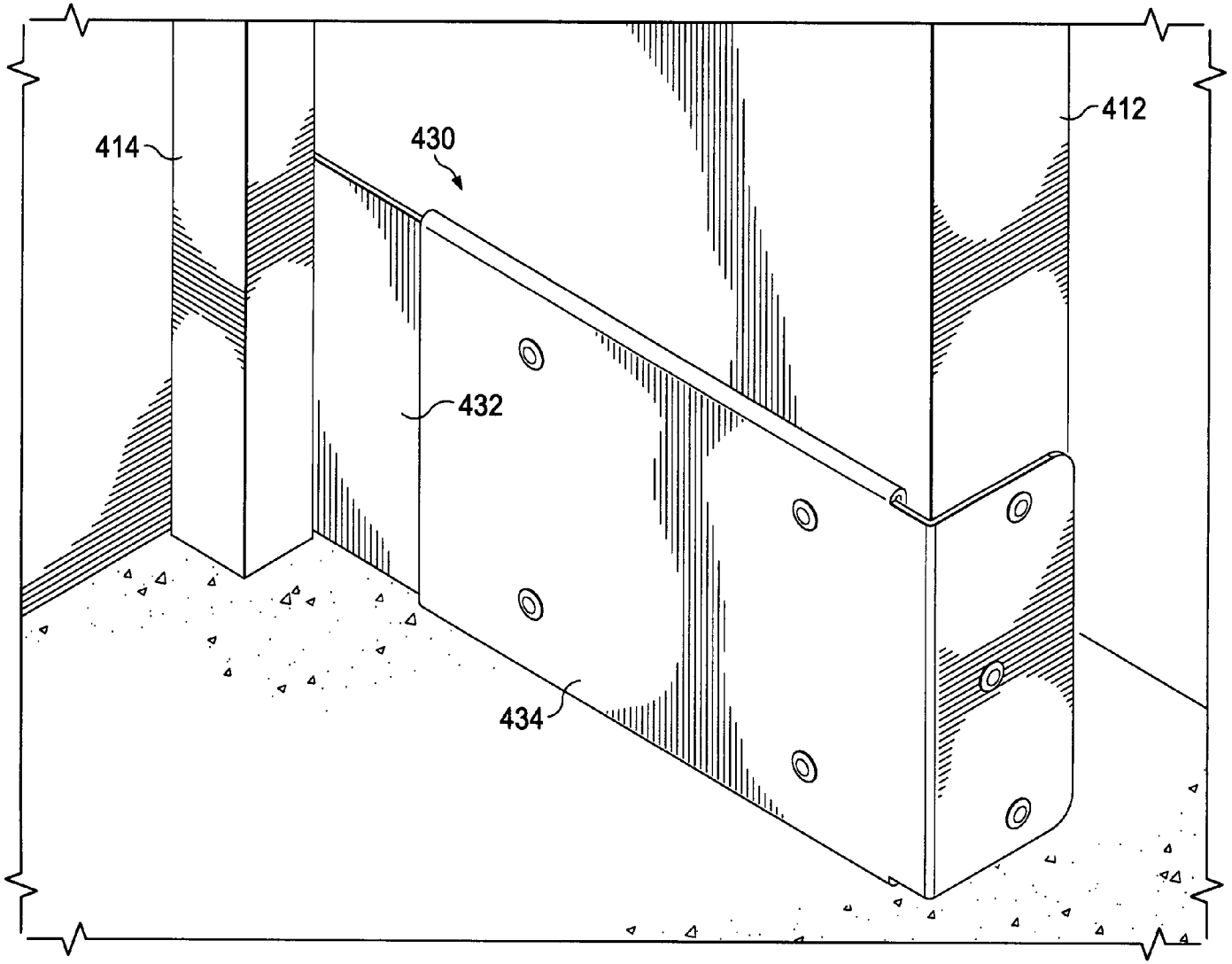
FIG. 5 depicts a detailed view of the door jamb with the installed adjustable jamb wrap.

As shown in FIG. 5, the jamb wrap 430 includes an inner bracket 432 and an outer bracket 434. The inner bracket 432 may represent the inner bracket 110 and/or the inner bracket 200. Likewise, the outer bracket 434 may represent the outer bracket 120 and/or the outer bracket 300. During installation, the inner bracket 432 slides between the trim piece 414 and the right jamb 412, with the angled portion of the inner bracket 432 (not shown) fitting tightly against the inner edge of the right jamb 412. The outer bracket 434 slides over the inner bracket 432, with one end of the inner bracket 434 sliding into grooves on the back side of the outer bracket 434. The angled portion of the outer bracket 434 fits tightly up against the outer edge of the right jamb 412. Holes in the inner bracket 432 and the outer bracket 434 (like the holes 214*a*-214*c*, 314*a*-314*c*, and 324*a*-324*d*) allow the brackets 432, 434 to be secured to the edges and side of the right jamb 412 using screws, nails, or any other suitable fasteners.

In preferred embodiments, the jamb wrap 430 is powder-coated or painted to match or blend with the color of the door jamb 400. In certain embodiments, the jamb wrap 430 may be manufactured in a variety of predetermined colors. In some embodiments, the jamb wrap 430 may be paintable to any desired color.

Because the inner bracket 432 and the outer bracket 434 slide with respect to each other, the jamb wrap 430 is adjustable to fit door jambs of different sizes. For example, a jamb wrap including the dimensions of the inner bracket 200 and the outer bracket 300 is adjustable to fit door jambs approximately seven to thirteen inches (7"-13") wide. It will be understood that other jamb wraps having other dimensions to fit smaller or larger door jambs are possible.

FIG. 4 depicts the jamb wrap 430 installed on only the right jamb 412. No jamb wrap is installed on the left jamb 402. This is only to illustrate the details of the door jamb 400 and the opening 408. It will be understood that preferred embodiments include installation of the jamb wrap 430 on both the left jamb 402 and the right jamb 412.

It may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A structure having an exterior door, the exterior door having a frame with a door jamb, the door jamb comprising:

a top jamb; and first and second side jambs, wherein each side jamb comprises an adjustable door jamb wrap, each door jamb wrap comprising:

an outer bracket having an "L" shape with a first portion and a second portion, wherein the first portion lies in a first plane and the second portion lies in a second plane perpendicular to the first plane, wherein the first portion comprises a plurality of grooves that form a channel, wherein a longitudinal axis of each groove of the plurality of grooves is orthogonal to the second plane, wherein a length of the first portion is greater than a width of the first portion, and wherein the length of the first portion extends in a direction parallel to the plurality of grooves; and an inner bracket having an "L" shape, the inner bracket slidably coupled to the outer bracket in a first direction via the channel, wherein a length of the inner bracket is greater than a width of the inner bracket, and wherein the length of the inner bracket extends in direction parallel to the first direction;

wherein the inner bracket and the outer bracket together form a "C" shape having an adjustable size and configured to wrap a bottom edge of the door jamb.

2. The structure of claim 1, wherein the outer bracket comprises a plurality of grooves configured to accept edges of the inner bracket, the plurality of grooves constraining the inner bracket to a sliding movement with respect to the outer bracket.

3. The structure of claim 1, wherein the inner bracket and the outer bracket have a plurality of apertures, each aperture configured to accept a fastening device, the fastening device configured to affix the inner and outer brackets to the door jamb.

4. The structure of claim 3, wherein at least one of the apertures in the outer bracket is in a bent section of the outer bracket, the bent section configured to be affixed to an outer edge of the door jamb by a fastener through each of the at least one aperture.

5. The structure of claim 3, wherein at least one of the apertures in the inner bracket is in a bent section of the inner bracket, the bent section configured to be affixed to an inner edge of the door jamb by a fastener through each of the at least one aperture.

6. The structure of claim 1, wherein the plurality of grooves are defined by tabs folded from the top and bottom edges of the outer bracket.

7. The structure of claim 1, wherein the door jamb wrap, when installed, is configured to cover an opening adjacent a bottom corner of the exterior door.

8. The structure of claim 1, wherein the inner and outer brackets comprise a steel material.

9. A method for covering an opening at a bottom edge of a door jamb of an exterior door, comprising:

placing an inner bracket of an adjustable door jamb wrap against the bottom end of the door jamb in a first direction, wherein a length of the inner bracket is greater than a width of the inner bracket, and wherein the length of the inner bracket extends in a direction parallel to the first direction;

placing an outer bracket of the door jamb wrap adjacent the inner bracket, wherein the outer bracket has a first portion which lies in a first plane and a second portion which lies in a second plane perpendicular to the first plane, wherein the first portion comprises a plurality of grooves that form a channel, wherein the longitudinal axis of each groove of the plurality of grooves is orthogonal to the second plane, wherein a length of the first portion is greater than a width of the first portion, and wherein the length of the first portion extends in a direction parallel to the plurality of grooves;

sliding the outer bracket over the inner bracket via the channel until the inner bracket and outer bracket together form a "C" shape wrapping the bottom edge of the door jamb; and fastening the inner bracket and the outer bracket of the door jamb wrap to the door jamb with a plurality of fasteners passing through a plurality of apertures in each of the inner bracket and the outer bracket.

10. The method of claim 9, wherein the plurality of grooves are defined by tabs folded from the top and bottom edges of the outer bracket.

* * * * *